US011537085B2

(12) United States Patent
Born et al.

(10) Patent No.: US 11,537,085 B2
(45) Date of Patent: Dec. 27, 2022

(54) SELF-ADJUSTABLE HOROLOGICAL OSCILLATOR

(71) Applicant: The Swatch Group Research and Development Ltd, Marin (CH)

(72) Inventors: Jean-Jacques Born, Morges (CH); Paulo Bravo, Marin-Epagnier (CH); Olivier Matthey, Mauborget (CH)

(73) Assignee: The Swatch Group Research and Development Ltd, Marin (CH)

( * ) Notice: Subject to any disclaimer, the term of this patent is extended or adjusted under 35 U.S.C. 154(b) by 466 days.

(21) Appl. No.: 16/821,038

(22) Filed: Mar. 17, 2020

(65) Prior Publication Data

US 2020/0319598 A1 Oct. 8, 2020

(30) Foreign Application Priority Data

Apr. 3, 2019 (EP) ..... 19166996

(51) Int. Cl.
*G04C 3/06* (2006.01)
*G04C 11/08* (2006.01)
(Continued)

(52) U.S. Cl.
CPC ..... *G04C 11/084* (2013.01); *G04B 17/063* (2013.01); *G04B 17/20* (2013.01);
(Continued)

(58) Field of Classification Search
CPC ..... G04B 17/063; G04B 17/20; G04D 7/12; G04C 10/00; G04C 3/06; G04C 11/084; G04C 11/08
See application file for complete search history.

(56) References Cited

U.S. PATENT DOCUMENTS 3,487,629 A * 1/1970 Takamune et al. .... G04C 3/065 318/132
7,016,265 B2 * 3/2006 Born ..... G04C 3/066 368/162
(Continued)

FOREIGN PATENT DOCUMENTS

CH 713306 A2 6/2018
CN 1603981 A 4/2005
(Continued)

OTHER PUBLICATIONS

Communication dated Apr. 27, 2021 in Chinese Application No. 202010259849.6.
(Continued)

*Primary Examiner* — Sean Kayes
(74) *Attorney, Agent, or Firm* — Sughrue Mion, PLLC

(57) ABSTRACT

A horological movement (6) including: a plate (7); a mechanical resonator (8) including an oscillating balance (11) rotatably mounted relative to the plate (7), and a spiral spring (22) coupled to the balance (11); an electromagnetic regulator (29) coupled to the mechanical resonator (8) to regulate the frequency of the oscillations of the balance (11), and including at least one permanent magnet (30) fixedly mounted relative to the plate (7), at least one coil (31), a quartz or silicon resonator (32) and an electronic circuit (33) connected to the resonator (32) and to the coil (31), all mounted on the balance (11) while being completely included in an inner cavity (18) delimited by the latter.

12 Claims, 11 Drawing Sheets

(51) Int. Cl.

| | |
|---|---|
| ***G04B 17/06*** | (2006.01) |
| ***G04B 17/20*** | (2006.01) |
| *G04C 10/00* | (2006.01) |
| *G04D 7/12* | (2006.01) |

(52) U.S. Cl.
CPC ..... *G04C 3/06* (2013.01); *G04C 10/00* (2013.01); *G04D 7/12* (2013.01)

(56) References Cited

U.S. PATENT DOCUMENTS

| | | | | |
|---|---|---|---|---|
| 7,306,364 | B2 * | 12/2007 | Born | G04C 11/084 368/204 |
| 7,891,862 | B2 * | 2/2011 | Tu | G04C 5/005 368/162 |
| 8,240,910 | B2 * | 8/2012 | Orny | G04B 18/006 368/169 |
| 10,338,527 | B2 * | 7/2019 | Tombez | G04B 5/08 |

FOREIGN PATENT DOCUMENTS

| | | | |
|---|---|---|---|
| CN | 101091141 | A | 12/2007 |
| CN | 100480901 | C | 4/2009 |
| CN | 103092057 | A | 5/2013 |
| CN | 105659168 | A | 6/2016 |
| CN | 106444337 | A | 2/2017 |
| CN | 107111277 | A | 8/2017 |
| CN | 107533320 | A | 1/2018 |
| CN | 108241281 | A | 7/2018 |
| EP | 1521141 | A1 | 4/2005 |
| EP | 3037894 | A1 | 6/2016 |

OTHER PUBLICATIONS

Communication dated Oct. 3, 2019, issued by the European Patent Office in counterpart European Application No. 19166996.9.

* cited by examiner

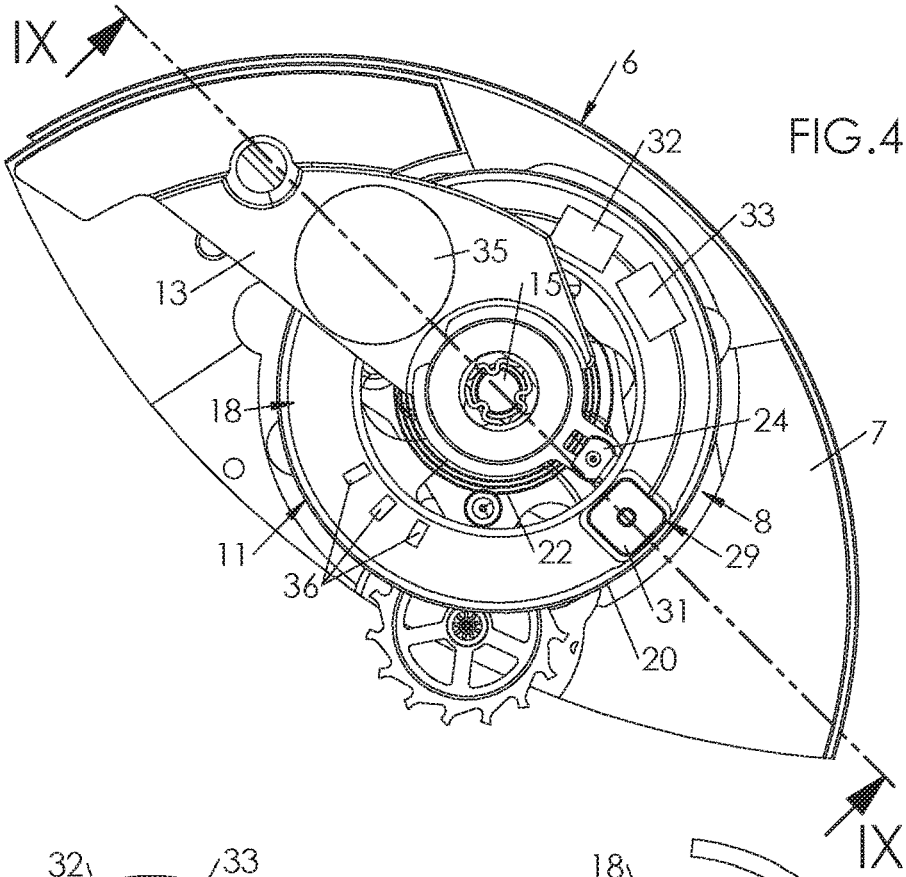
FIG.4
FIG.5
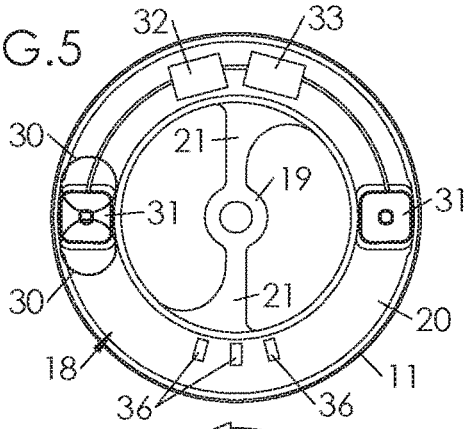
FIG.6
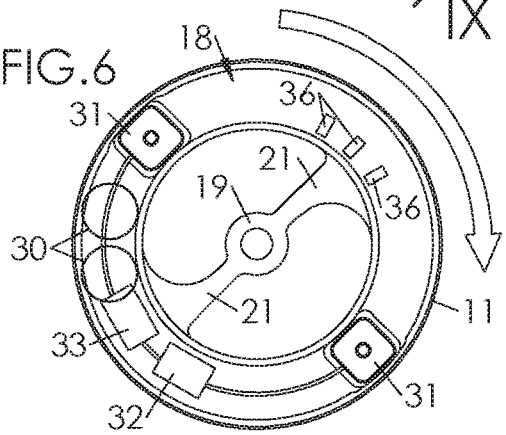
FIG.7
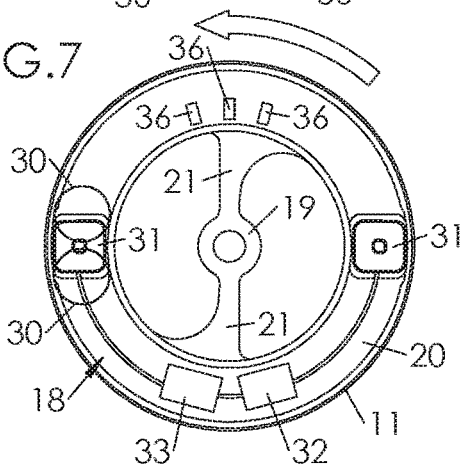
FIG.8
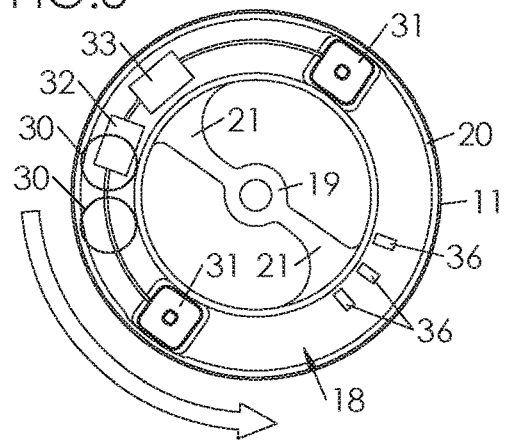

SELF-ADJUSTABLE HOROLOGICAL OSCILLATOR

A horological movement equipped with a mechanical balance resonator and an electromagnetic regulator provided with a coil integrated into the balance.

CROSS-REFERENCE TO RELATED APPLICATIONS

This application is based on and claims priority under 35USC 119 from European Patent Application No. 19166996.9 filed Apr. 3, 2019, which is incorporated herein by reference in its entirety.

TECHNICAL FIELD

The invention relates to the field of watchmaking. More specifically, it relates to a horological movement intended to equip a watch and comprising:

- A mechanical resonator comprising a balance coupled to a spiral spring and animated by periodic oscillations,
- An electromagnetic regulator coupled to the mechanical resonator to regulate the frequency of the oscillations,
- An electric generator allowing to power the electromagnetic regulator.

PRIOR ART

The operation of a horological movement, and its ability to tell the time with precision, depends on the precision of its mechanical resonator, that is to say on the precision—and the constancy—of its frequency of oscillation.

However, it is known that various factors can affect the oscillation frequency of a mechanical resonator:

- Barrel coiling level (it is known that the motor torque generated by the barrel varies depending on its coiling level),
- Ambient temperature (it is known that the temperature affects both mechanical parts, which expand when heated and contract when cold, and lubricants, which are fluid when heated and viscous when cold),
- Spatial orientation of the watch (it is known that gravity, the vector of which is not fixed in the variable reference frame of a wristwatch, has an influence on the movement of movable parts, and particularly of the balance).

To limit the variations in the oscillation frequency of the mechanical resonator, it is known to equip the movement with an electromagnetic regulator which takes part of the mechanical energy from the balance, converts it into electricity, and induces on the balance an electromotive or counter-electromotive force depending on whether it is necessary to increase its oscillation frequency or, on the contrary, to decrease it to maintain it within a range allowing to guarantee the precision of the movement.

The problem of regulating the oscillation frequency of a mechanical resonator is well detailed in the Swiss patent application CH 713 306, which moreover proposes, in order to solve it, a regulating device provided with a measuring device arranged to determine whether the mechanical resonator is affected by a gain or a loss, and with a regulating impulse application device arranged to be able to selectively apply to the mechanical resonator a first braking impulse or, respectively, a second braking impulse.

Concretely, the regulation system comprises:

- A pair of movable permanent magnets, carried by the balance,

- A fixed coil, secured to a balance support, opposite which the magnets pass during the rotation of the balance;
- A quartz resonator also secured to the balance support;
- An electronic control circuit connected to the coil and the quartz resonator, and arranged to calculate the instants of application of the regulation impulses.

If the solution proposed by the Swiss patent CH 713 306 effectively solves the problem of regulating the mechanical resonator, it poses several new problems:

- An aesthetic problem: the components of the regulating device are visible to the wearer of the watch (through a closing crystal of the case);
- A problem of size: it is indeed necessary to provide, among the existing components of the movement, a place for the components of the regulating device, and particularly for the coil, the quartz resonator and the electronic control circuit;
- A problem of magnetic coupling: the magnets carried by the balance circulate, during the rotation of the balance, in an environment containing metallic parts likely to interact with the magnetic field of the magnets and therefore to induce an uncontrolled braking torque on the balance.

A purpose of the invention is to provide a solution to these problems.

SUMMARY OF THE INVENTION

First, to achieve this purpose, a horological movement is proposed, comprising:

- A plate;
- A mechanical resonator comprising:
  - An oscillating balance rotatably mounted relative to the plate about an axis, this balance having an upper face and a lower face, and
  - A spiral spring coupled to the balance, this spiral spring having a first end fixed relative to the plate and a second end secured to the balance;
- An electromagnetic regulator coupled to the mechanical resonator to regulate the frequency of the balance oscillations, this electromagnetic regulator comprising
  - At least one permanent magnet fixedly fixed relative to the plate;
  - At least one coil, a quartz resonator and an electronic circuit connected to the resonator and to the coil, all mounted on the balance while being completely included in at least one inner cavity delimited by the latter.

This movement has a size similar to a conventional mechanical movement, while solving the problem of magnetic coupling (in particular thanks to the immobility of the permanent magnets).

Various additional features can be provided, alone or in combination.

Thus, for example, the cavity is blind on the side of at least one of the faces of the balance.

The regulator may comprise a pair of coils. These coils are preferably diametrically opposite but, in some configurations, they can be angularly offset by 120° for example.

The electromagnetic regulator preferably comprises capacitors coupled to the electronic circuit.

A cover is advantageously mounted on the balance to close the cavity.

The (or each) permanent magnet is preferably made of a neodymium-iron-boron alloy.

According to various embodiments, the electromagnetic regulator comprises:

At least one pair of magnets fixedly mounted relative to the plate on the side of the upper face of the balance;

At least two magnets opposite each other, namely an upper magnet fixedly mounted relative to the plate on the side of the upper face of the balance, and a lower magnet fixedly mounted relative to the plate on the side of the lower face of the balance;

At least two pairs of magnets, namely a first pair of upper magnets fixedly mounted relative to the plate on the side of the upper face of the balance, and a pair of lower magnets fixedly mounted relative to the plate on the side of the lower face of the balance.

Second, a watch equipped with a movement as presented above is proposed.

BRIEF DESCRIPTION OF THE FIGURES

Other objects and advantages of the invention will appear in light of the description of an embodiment, made below with reference to the appended drawings wherein:

FIG. 4 is a plan view of the movement according to the invention;

FIG. 5, FIG. 6, FIG. 7 and FIG. 8 are partial plan views illustrating the movement of the balance equipping the movement;

DETAILED DESCRIPTION OF THE INVENTION

Figure 1:
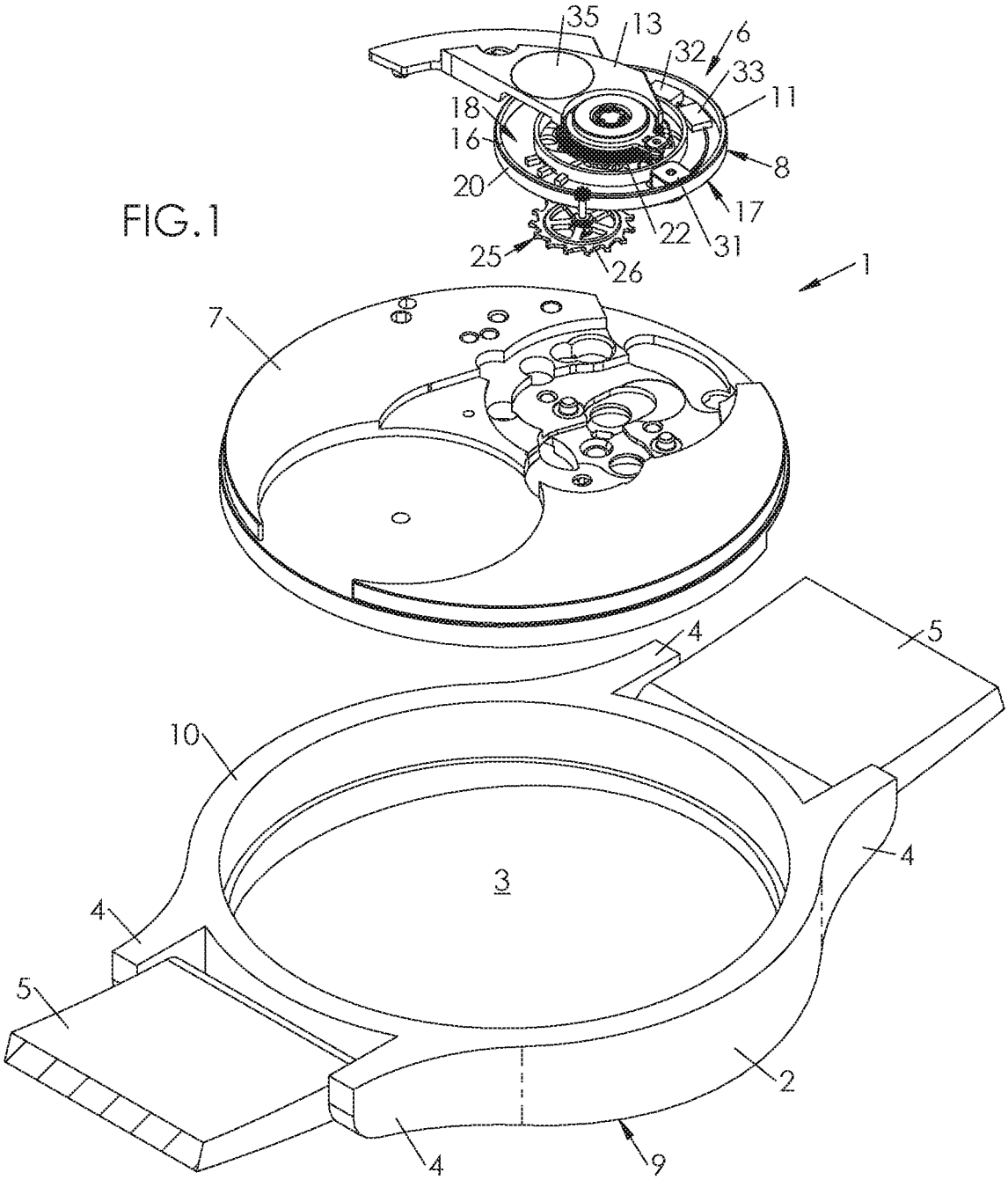
FIG. 1 is an exploded perspective view, from below, of a watch equipped with a movement according to the invention.

FIG. 1 partially shows a timepiece, in this case a watch 1. The watch 1 comprises a middle part 2 which defines an internal volume 3. In the illustrated example, the watch 1 is designed to be worn on the wrist. To this end, the middle part 2 comprises horns 4, on which a bracelet 5 is fixed.

The watch 1 comprises a horological movement 6 designed to indicate at least the hours and the minutes. The movement 6 is of the mechanical type (that is to say that the energy is supplied by a barrel spring); its winding can be manual (that is to say that the coiling of the barrel spring is performed manually by means of a winding-mechanism) or automatic (that is to say that the coiling of the barrel spring results from the rotation of an oscillating mass).

The movement 6 comprises:

A plate 7 intended to be housed in the internal volume 3 defined by the middle part 2 by being fixed to the latter (typically by means of screws);

A mechanical resonator 8 mounted on the plate 7 and designed to provide a running rate for time indicators, typically hour and minute hands.

The watch 1 further includes a crystal and a back (not shown), fixed to the middle part 2 on the side, respectively, of a front face 9 (where the information intended for the wearer are displayed) and of a rear face 10 (against the wearers wrist).

Most of the components of the movement 6 are on the side of the plate 7 turned to the rear face 10 of the middle part 2 (in other words, the plate 7 is mounted upside down in the middle part 2). Consequently, in what follows, the term "upper" designates a direction oriented towards the rear face 10 of the middle part 2, while the term "lower" designates a direction oriented towards its front face 9.

Conventionally, the mechanical resonator 8 comprises, first, an oscillating balance 11 rotatably mounted relative to the plate 7 about an axis 12. More specifically, the balance 11 is mounted between the plate 7 and a balance bridge 13 fixed thereon. The plate 7 incorporates a lower bearing 14 wherein a lower end of the axis 12 is fitted. The balance bridge 13 incorporates an upper bearing 15 wherein an upper end of the axis 12 is fitted.

The balance 11 performs a flywheel function. It has an upper face 16 and a lower face 17 which jointly delimit at least one inner cavity 18. The balance 11 can be made of brass. However, it is preferably made of a material which does not conduct electricity, for example of ceramic, quartz, silicon or of a polymer to prevent eddy current loss.

Figure 2:
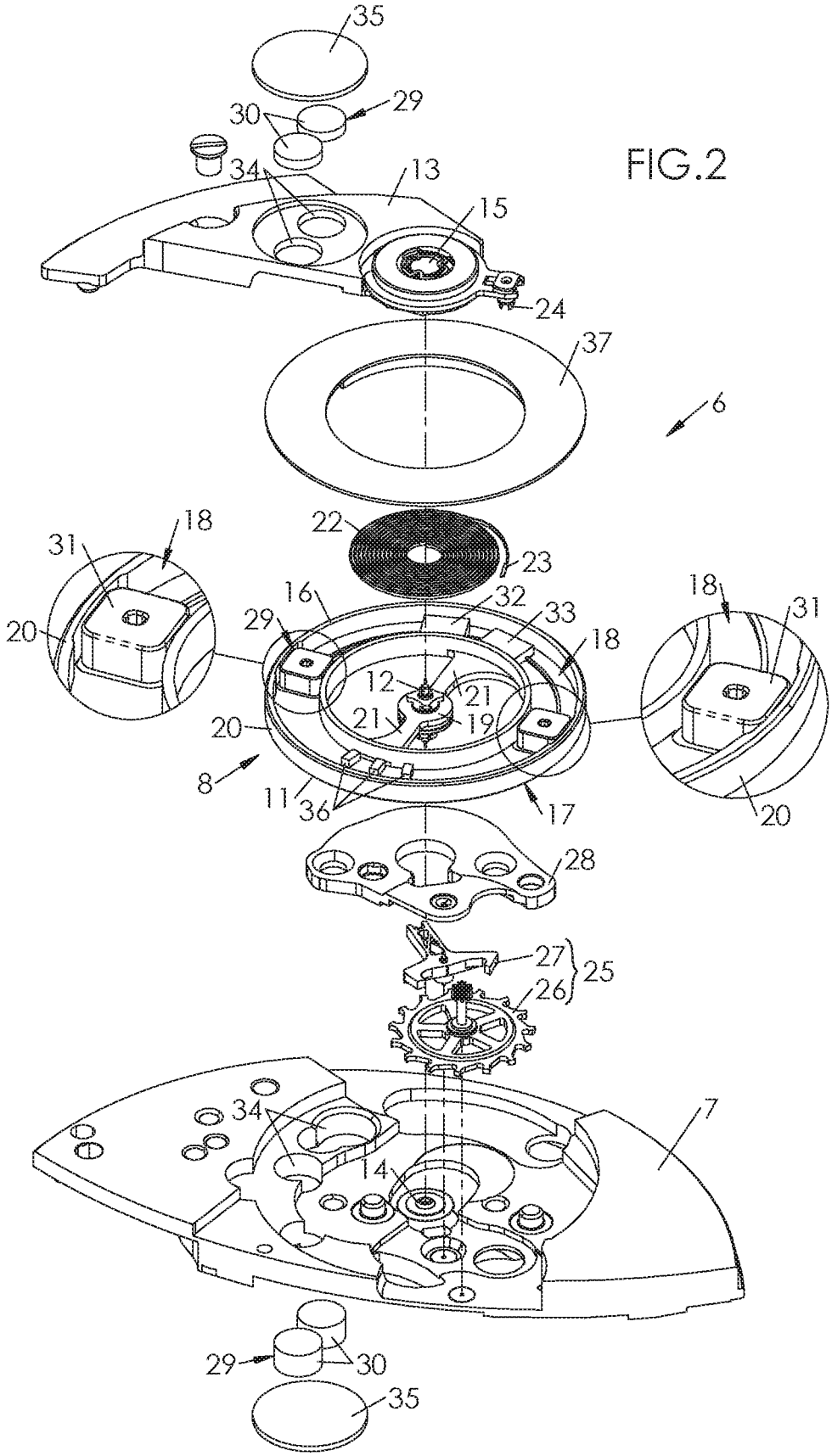
FIG. 2 is an exploded perspective view of the movement according to the invention, on the lower face side.
Figure 3:
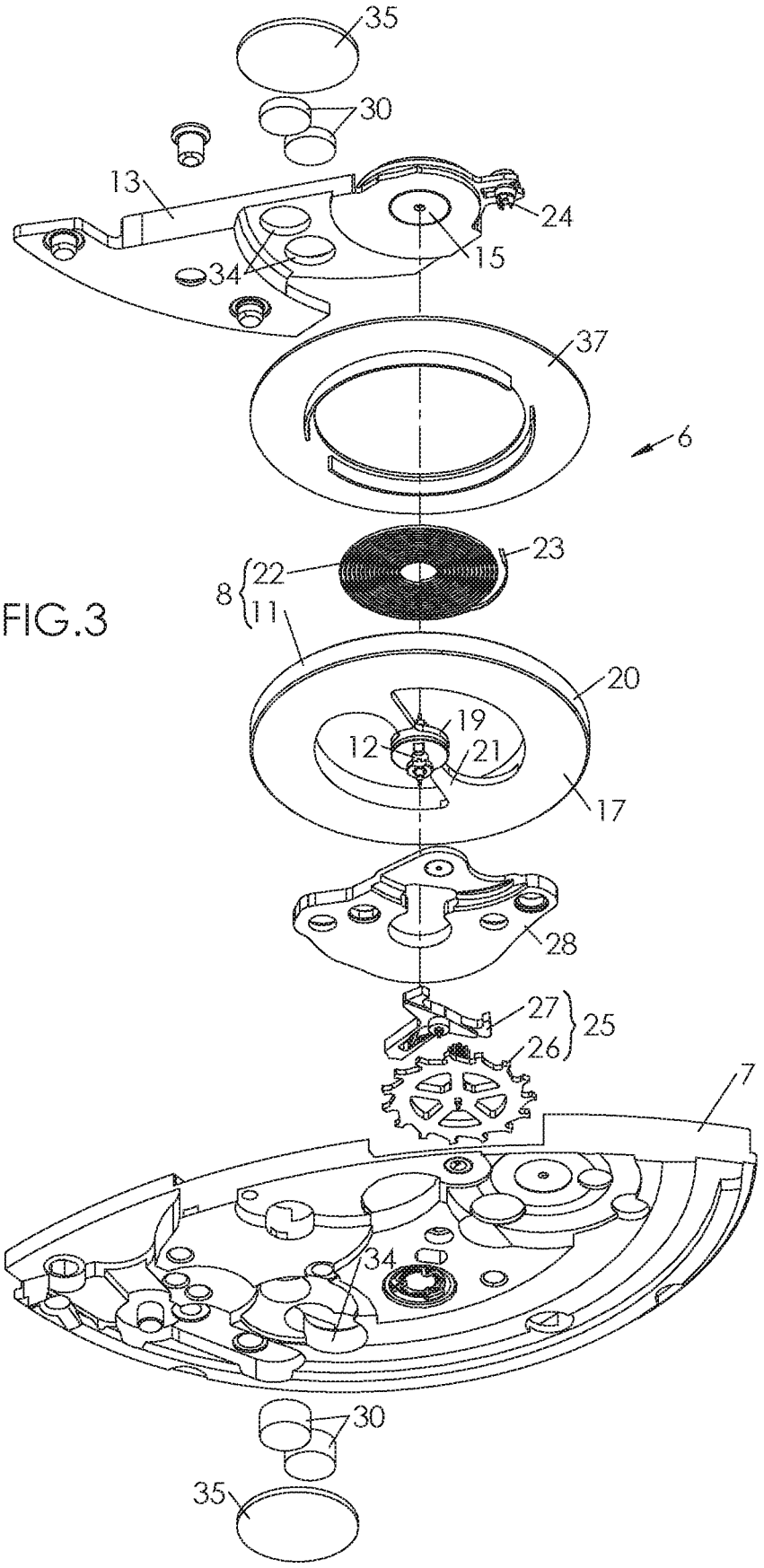
FIG. 3 is an exploded perspective view of the movement of FIG. 2, on the upper face side.

According to a preferred embodiment illustrated in the drawings, and in particular in FIG. 2 and FIG. 3, the cavity 18 is blind (that is to say non-opening) on at least one of the faces 16, 17 (on the lower face 17 in the illustrated example).

As illustrated in particular in FIG. 2, the balance 11 comprises:

A hub 19 by which it is driven on its axis 12,

A felloe 20, in the form of a peripheral ring, and

One or more arm(s) 21 (here two in number, but this number is only illustrative) which connect(s) the hub 19 to the felloe 20.

Second, the mechanical resonator 8 comprises a spiral spring 22 coupled to the balance 11. The spiral spring 22 is for example made of silicon, quartz, diamond or any other non-magnetic material known to the person skilled in the art. The spiral spring 22 has a first end 23 fixed relative to the plate 7, and a second end secured to the balance 11. More specifically, the first end 23, outside the spiral spring 22, is trapped in a stud holder 24 secured to the upper bearing 15. The second end, inside the spring, is secured to the axis 12 of rotation of the balance 11.

The mechanical resonator 8 is intended, by the alternating rotation of the balance 11 accompanied (and constrained) by the compression-detent cycles of the spiral spring 22, to make the rotation of a train for transmitting a motor torque (produced by a barrel spring which is not shown) to display organs (typically hands) sequential and regular.

The coupling of the mechanical resonator 8 to the transmission train is ensured by an escapement mechanism 25 which comprises:

An escapement wheel 26, rotatably mounted on the plate 7 and provided with an asymmetrical peripheral toothing, and Pallets 27, rotatably mounted between the plate 7 and a pallets bridge 28 and provided with a pair of palletstones which attack the toothing of the escapement wheel 26, and a stick provided, at one end, with a fork which cooperates with a pin secured to the axis 12 of rotation of the balance 11.

While mechanical movements are highly appreciated by watchmaking enthusiasts for their authenticity, however they remain less precise than quartz movements, due to the potential variations in the rate of mechanical resonators.

The rate of the mechanical resonator 8 can in particular be affected by the coiling level of the barrel spring, the ambient temperature or else the spatial orientation of the watch 1.

While remaining mechanical, that is to say drawing its motive energy from a spring, the movement 6 is made more precise being equipped with a regulator 29 of the electromagnetic type which corrects any variations in the rate of the mechanical resonator 8.

More specifically, the electromagnetic regulator 29 is coupled to the mechanical resonator 8 to regulate the frequency of the oscillations of the balance 11. This electromagnetic regulator 29 comprises:

At least one permanent magnet 30,

At least one coil 31,

A quartz or silicon resonator 32 and

An electronic circuit 33 connected to the resonator and to the coil.

As illustrated in particular in FIG. 2 and FIG. 3, the magnet 30 (or each magnet 30) is fixedly mounted relative to the plate 7, while the coil 31 (or each coil 31), the quartz resonator 32 and the electronic circuit 33 are mounted on the balance 11 while being completely included in the cavity 18 delimited by the latter.

The magnet 30 (or the magnets 30) generate(s) a permanent (that is to say the value of which is invariable in time) and stationary (that is to say the value of which is invariable at each point in space, using the plate 7 as a reference). This magnetic field is partially illustrated in dashed lines in FIG. 9.

The magnet 30 (or each magnet 30) is advantageously made of a neodymium-iron-boron alloy, which provides the advantage of generating a strong magnetic field while being of contained volume (and mass).

The magnet 30 (or each magnet 30) is preferably at least partly (and preferably totally, even totally) housed in a hollow 34 formed in the plate 7 (or in the balance bridge 13).

The electromagnetic regulator 29 preferably comprises at least one pair of magnets 30 fixedly mounted relative to the plate 7. These magnets 30 can be mounted side by side on the plate 7, or on the balance bridge 13.

According to a particular embodiment, the movement 6 comprises at least two magnets 30 opposite each other, namely:

An upper magnet 30 fixedly mounted relative to the plate 7 on the side of the upper face 16 of the balance 11 (this upper magnet 30 is for example fixed on the balance bridge 13), and A lower magnet 30 fixedly mounted relative to the plate 7 on the side of the lower face 17 of the balance 11 (this lower magnet 30 is for example fixed on the plate 7).

According to a particular embodiment illustrated in particular in FIG. 2 and FIG. 3, the electromagnetic regulator 29 comprises at least two pairs of magnets 30, namely:

A first pair of upper magnets 30 fixedly mounted relative to the plate 7 on the side of the upper face 16 of the balance 11 (these upper magnets 30 being here fixed on the balance bridge 13), and A pair of lower magnets 30 fixedly mounted relative to the plate 7 on the side of the lower face 17 of the balance 11 (the lower magnets 30 are here fixed on the plate 7).

In this case, the upper magnets 30 are advantageously positioned in line with the lower magnets 30. The opposite faces of the upper magnets 30 and of the lower magnets 30 are advantageously of the same polarity, so as to obtain a good local concentration of the magnetic field, and field lines oriented perpendicular to the plane swept by the balance 11.

Thanks to the use of neodymium-iron-boron alloy, the magnets 30, while generating a strong magnetic field, have a limited volume which allows their discrete integration in the plate 7 and/or in the balance bridge 13. In fact, it is even possible to make them invisible to the naked eye. It is also possible to mask them by means of one or more chip(s) 35 which may each, furthermore, play the role of a pole piece to concentrate the magnetic field generated by the magnets.

Figure 10:
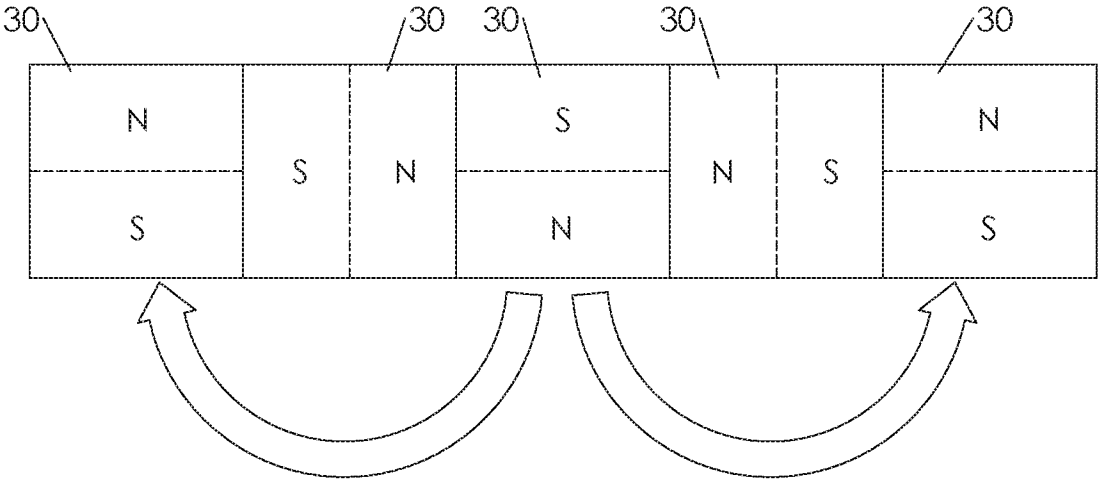
FIG. 10 is a diagram showing a possible magnetic configuration.

The magnets 30 can be arranged in various configurations, in addition to those which have just been described. Thus, it may be advantageous to arrange the magnets 30 according to a configuration, illustrated in FIG. 10, known as Halbach configuration, wherein several magnets 30 are disposed side by side with their polarities offset by 90° (it is easily understood, in FIG. 10, that the letters N and S respectively designate the north and south poles of the magnets 30). Such a configuration allows concentrating the magnetic field on one face of the series of magnets 30, as illustrated by the arrows, while the opposite face generates only a weak magnetic field.

According to a preferred embodiment illustrated in FIG. 2, the inner cavity 18 of the balance 11 is defined by the felloe 20: it is therefore in the felloe 20 that the (or each) coil 31, the quartz resonator 32 and the electronic circuit 33 are housed.

The passage of the (or each) coil 31 in the magnetic field generated by the magnet(s) 30 induces therein a current which powers the electronic circuit 33 and the quartz resonator 32. By reverse piezoelectric effect, the quartz resonator 32 vibrates at a predetermined fixed frequency and provides a clock rate to the electronic circuit 33. The electronic circuit 33 is programmed to measure the frequency of the oscillations of the balance 11 (which result in electrical impulses) and to compare them with a predetermined reference frequency, derived from the clock rate provided by the quartz.

As soon as the oscillation frequency of the balance 11 is decreed different from the reference frequency, the electronic circuit 33 imposes on the terminals of the coils 31 a voltage producing a counter-electromotive force which either increases the rotation frequency of the balance 11 (when this frequency is decreed lower than the reference frequency), or decreases it (when this frequency is decreed higher than the reference frequency), according to the instant at which this voltage is applied.

It will be noted that it is preferable that the distance between the quartz resonator 32 and the circuit 33 is small, so as to minimise any interference.

A magnetic regulation method of the oscillation frequency of the mechanical resonator 8 is proposed in patent application CH 713 306.

Figure 9:
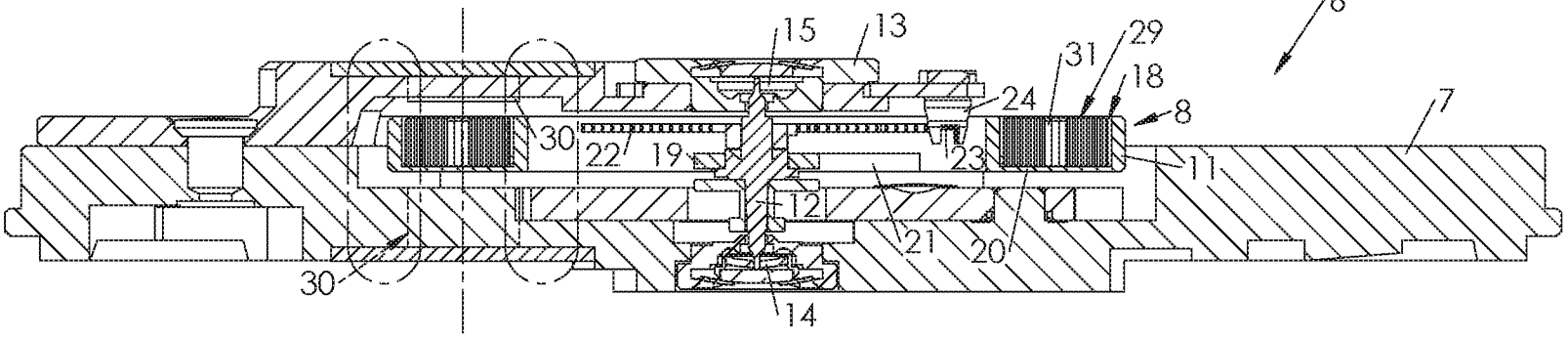
FIG. 9 is a sectional view of the movement along the plane IX-IX of FIG. 4.
Figure 11:
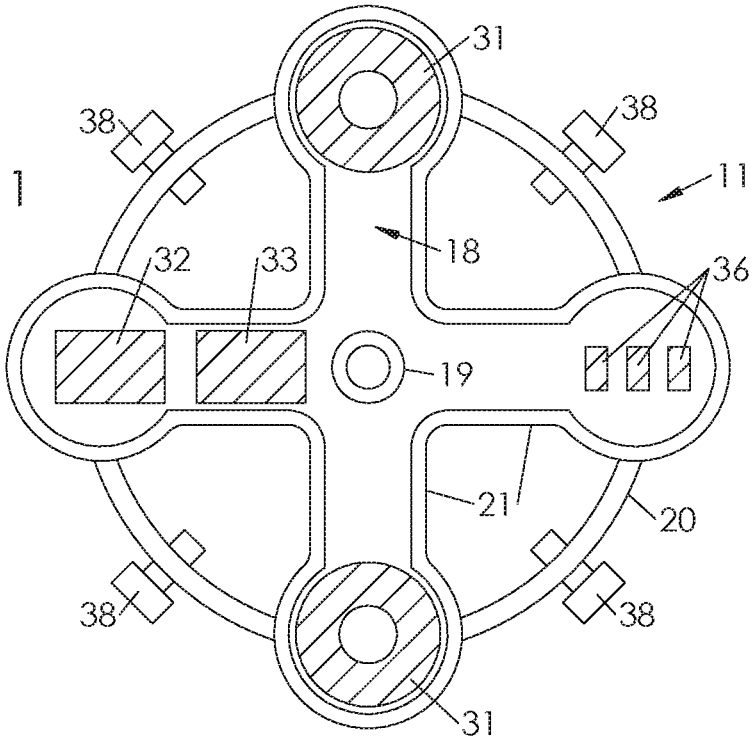
FIG. 11 to FIG. 22 show various architectural variants for the balance.
Figure 12:
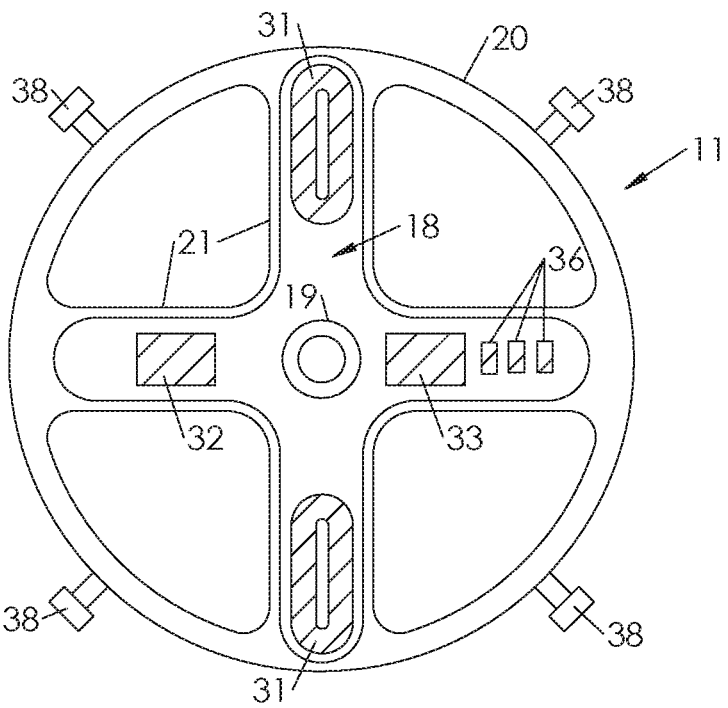
Figure 13:
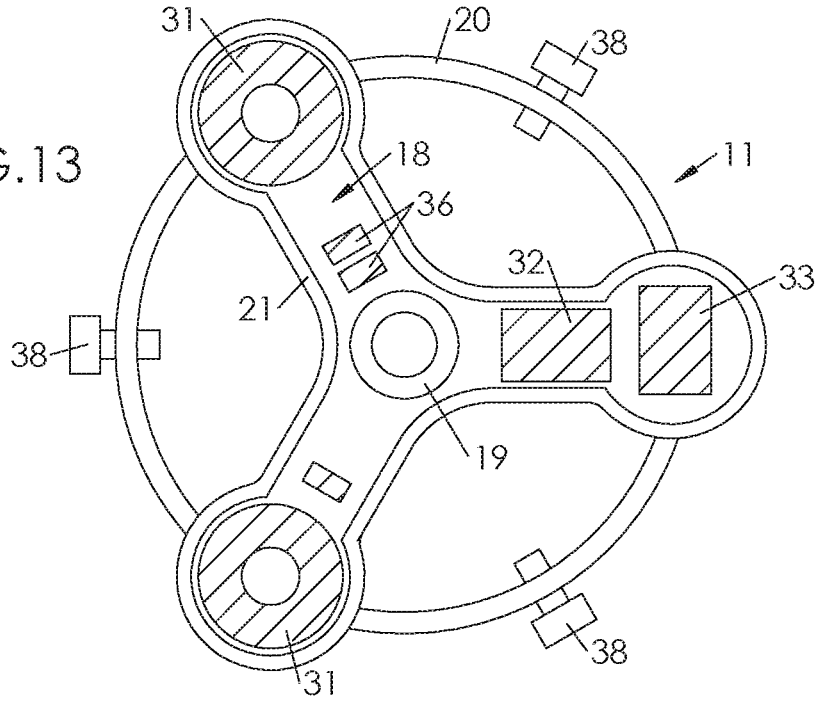
Figure 14:
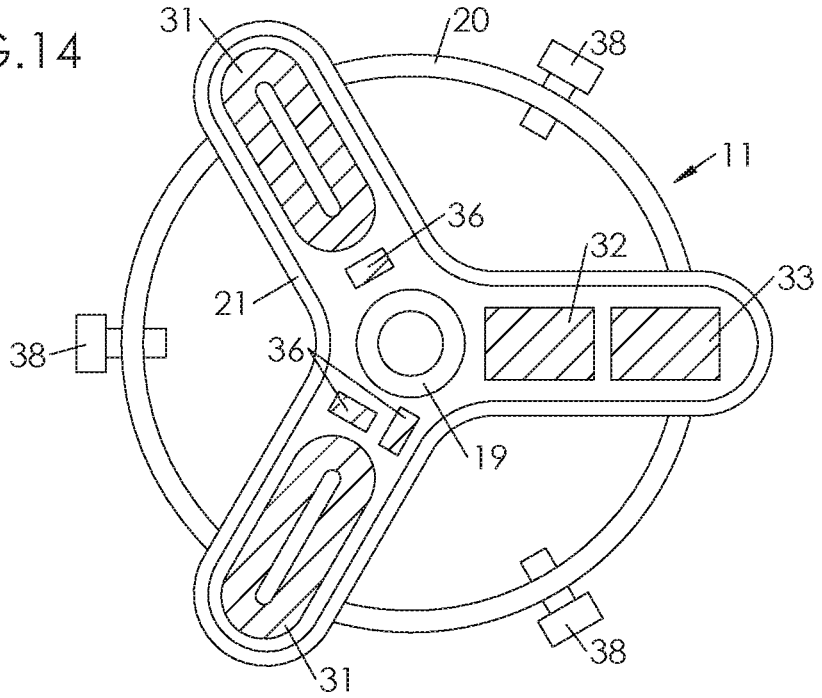
Figure 15:
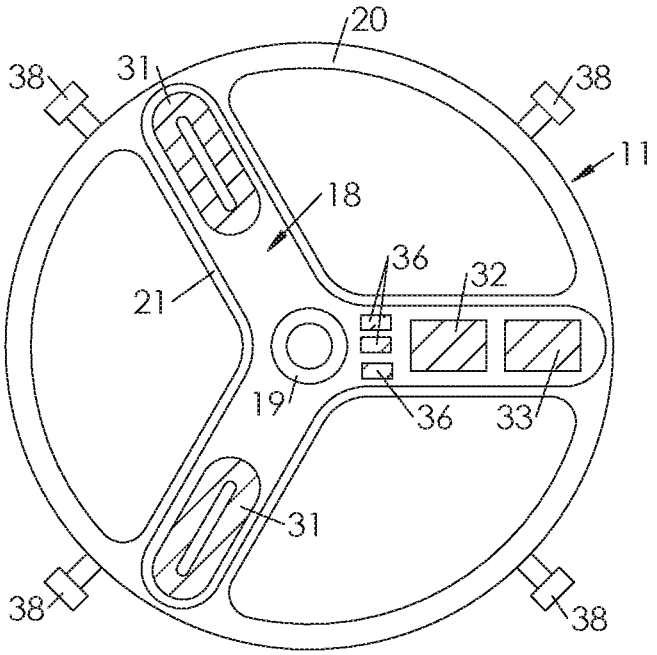

According to an embodiment illustrated in FIG. 2, in FIG. 5 to FIG. 8, in FIG. 9 and in FIG. 11 to FIG. 18, the electromagnetic regulator 29 comprises a pair of coils 31. These coils 31 can be diametrically opposite (FIG. 2, FIG. 5 to FIG. 8, FIG. 9, FIG. 11, FIG. 12, FIG. 16, FIG. 17 and FIG. 18). Alternatively, the coils 31 can be angularly offset by an angle of 120° for example, as illustrated in FIG. 13, FIG. 14 and FIG. 15.

It is the passage of one of the coils 31 in line with one of the magnets 30 (or with a pair of magnets 30) at the equilibrium point of the balance 11 (corresponding to the maximum speed thereof during the running of the movement 6) which, by electromagnetic induction, generates a current in the circuit 33. The passage of the other coil 31 in line with one of the magnets 30 (or a pair of magnets 30) is detected by the circuit 33 to ensure the regulation.

Figure 16:
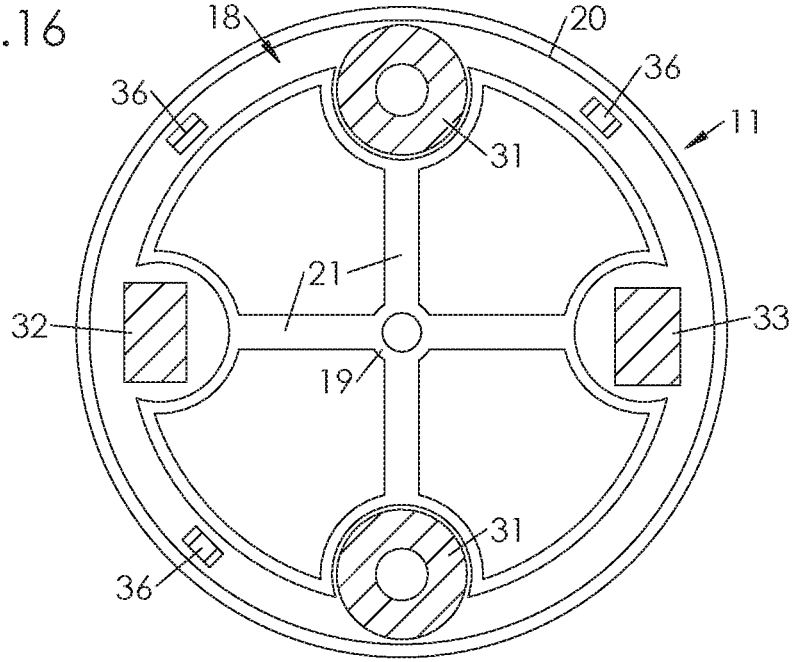
Figure 17:
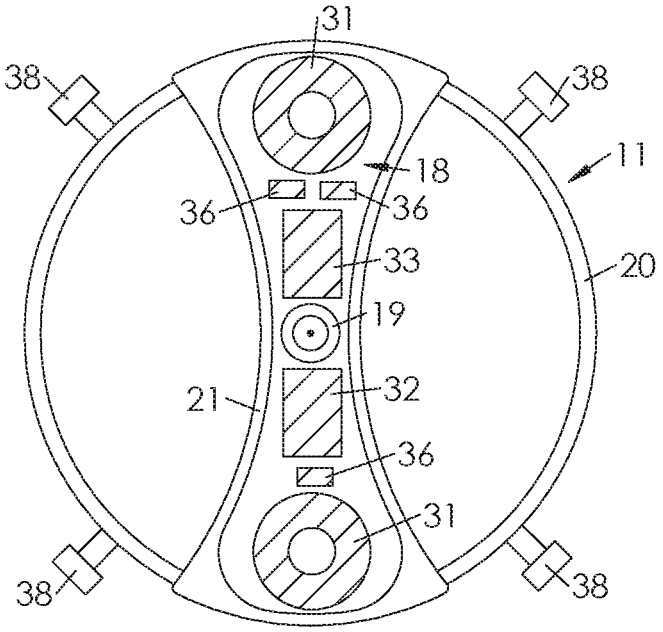
Figure 18:
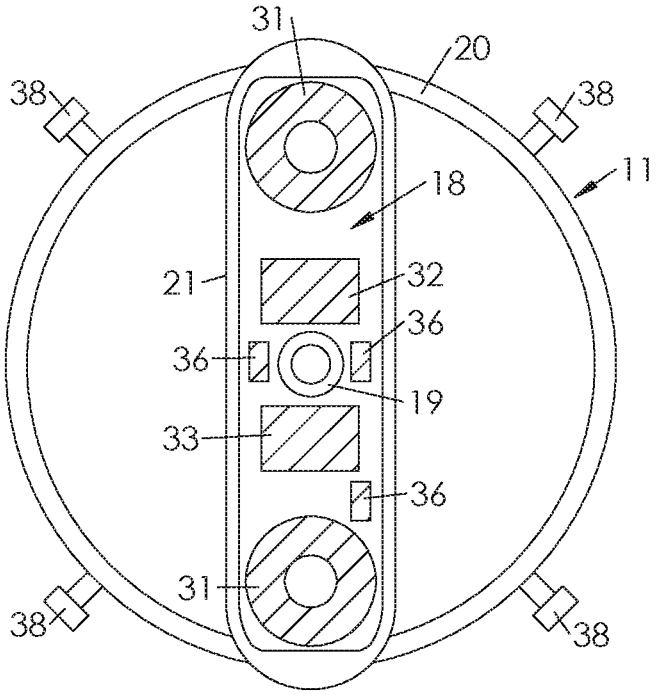
Figure 19:
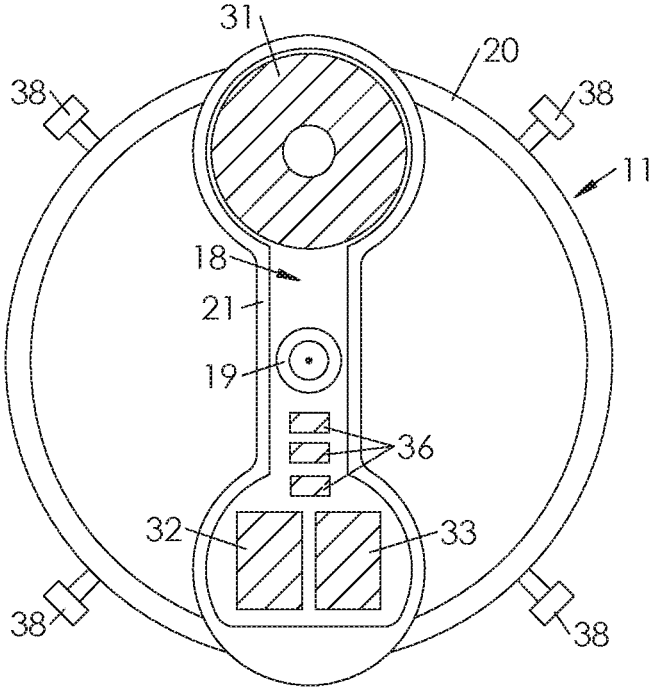
Figure 20:
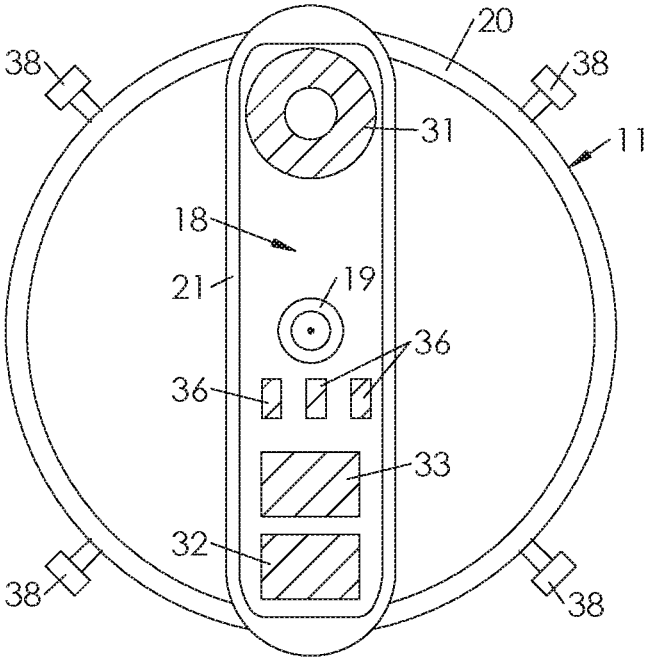
Figure 21:
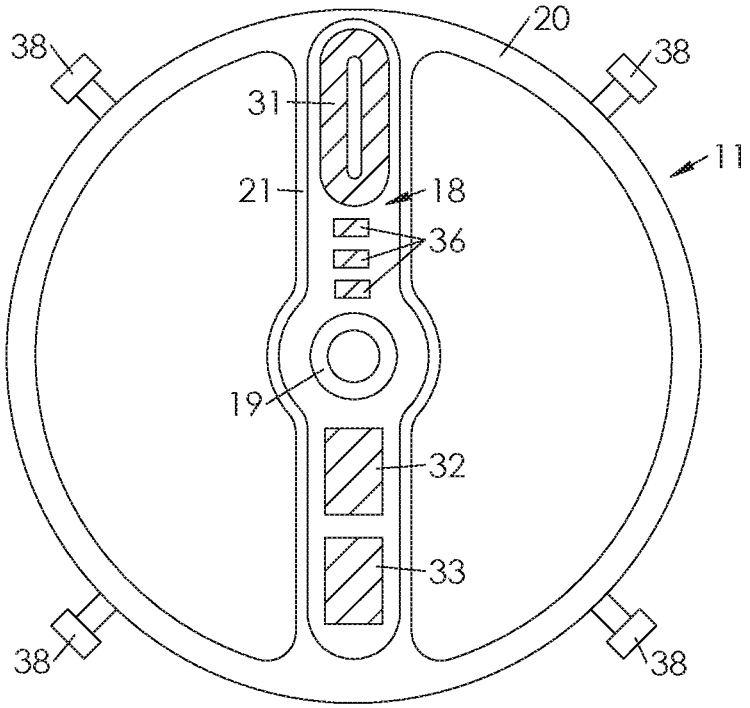
Figure 22:
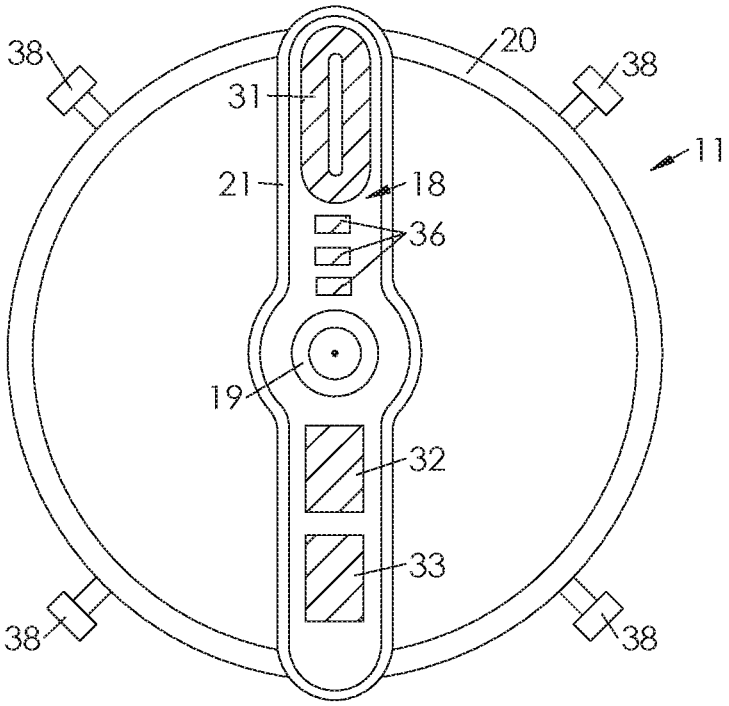

As illustrated in the drawings, various configurations of the balance 11 are possible:

With two arms 21 (FIG. 2, FIG. 5 to FIG. 8, FIG. 17 to FIG. 22), With three arms 21 (FIG. 13, FIG. 14, FIG. 15), With four arms 21 (FIG. 11, FIG. 12, FIG. 16).

Although two coils 31 are preferable, the electromagnetic regulator 29 may comprise only one coil 31 (FIG. 19 to FIG. 22) which passes alternately opposite two magnets 30 angularly offset (or two pairs of magnets 30 angularly offset).

The combinations are possible:

Balance 11 with two arms 21; one coil 31 (FIG. 19 to FIG. 22), Balance 11 with two arms 21; two coils 31 (FIG. 2, FIG. 5 to FIG. 8, FIG. 17, FIG. 18), Balance 11 with three arms 21; two coils 31 (FIG. 13, FIG. 14, FIG. 15), Balance 11 with four arms 21; two coils 31 (FIG. 11, FIG. 12, FIG. 16).

As illustrated in the drawings, the regulator 29 advantageously comprises capacitors 36 coupled to the circuit 33 and whose function is double: straightening the voltage across the terminals of the circuit 33; providing a gain on this voltage by increasing the value.

In the example illustrated in particular in FIG. 2 and FIG. 3, where the cavity 18 opens onto one of the faces of the balance (here the upper face 16), the movement 6 moreover comprises a cover 37 mounted on the balance 11 and which closes the cavity 18. This cover 37 allows the coils 31, the quartz resonator 32 and the electric circuit 33 to be hidden from the sight of the wearer, to the benefit of the aesthetics of the movement 6. This cover 37 is advantageously made of brass, which has the advantage of being non-magnetic and, consequently, of not affecting the movements of the balance 11 immersed in the magnetic field generated by the magnet 30 (or the magnets 30). Alternatively, the cover can be made of ceramic, quartz, silicon or a polymer.

It may be necessary to poise the masses on the balance 11. To this end, it can be pierced with hollows or holes, distributed so as to compensate for the disequilibrium induced by the embedded components (in particular the coils 31, the crystal resonator 32, the circuit 33 and the capacitors 36). Alternatively, or in combination, inertia-blocks 38, the number and/or position of which can be adjustable, can be mounted on the balance 11 (typically on the felloe 20).

The architecture which has just been described (in all its possible configurations) has several advantages.

Firstly, the electromagnetic regulator 29 is completely hidden, and invisible to the wearer of the watch 1, for the benefit of its aesthetics. This results from the fact that the movable components of the regulator 29 (coils 31, quartz resonator 32, circuit 33, capacitors 36) are included in the inner cavity 18 of the balance 11. These movable components are hidden from the sight of the wearer either by the blind face of the balance 11 (here the lower face 17), or by the cover 37. As for the magnets 30, they are also invisible (or at the very least discreet) by being masked either by the mass of the plate 7, or by the mass of the balance bridge 13, or by a chip 35.

Secondly, the inclusion of the space-saving magnet 30 (or magnets 30) in the plate 7 and/or in the balance bridge 13 does not require any particular modification of their shape, and particularly does not require to be thickened.

Thirdly, the inclusion of the coil(s) 31, the quartz resonator 32 and the electronic circuit 33 in the balance 11 (and more specifically in the felloe 20) does not generate any additional thickness. It may be necessary to widen the felloe 20 or the arms 21 where appropriate, but this widening does not affect the overall size of the balance 11.

Fourthly, since the magnets 30 are fixed, the magnetic field generated is permanent and stationary, without being affected by undesirable variations. As the coils 31 are in turn passive when they are outside the magnetic field generated by the magnets 30, the frequency of rotation of the balance 11 is not affected by the possible presence of metal parts in its immediate environment.

The invention claimed is:

1. A horological movement (6) comprising:

a plate (7);

a mechanical resonator (8) comprising:

an oscillating balance (11) rotatably mounted relative to the plate (7) about an axis (12), this balance (11) having an upper face (16) and a lower face (17), and a spiral spring (22) coupled to the balance (11), this spiral spring (22) having a first end (23) fixed relative to the plate (7) and a second end secured to the balance (11);

an electromagnetic regulator (29) coupled to the mechanical resonator (8) to regulate the frequency of the balance (11) oscillations, the electromagnetic regulator (29) comprising:

at least one permanent magnet (30), at least one coil (31), a quartz or silicon resonator (32) and an electronic circuit (33) connected to the resonator (32) and to the coil (31), wherein the magnet (30) is fixedly mounted relative to the plate (7); and the coil (31), the resonator (32) and the electronic circuit (33) are mounted on the balance (11) while being completely included in at least one inner cavity (18) delimited by the latter.

2. The movement (6) according to claim 1, wherein the cavity (18) is blind on the side of at least one of the faces (16, 17) of the balance (11).

3. The movement (6) according to claim 1, wherein the balance (6) comprises a felloe (20) which defines a cavity (18) wherein the (or each) coil (31), the quartz resonator (32) and the electronic circuit (33) are housed.

4. The movement (6) according to claim 1, wherein the regulator (29) comprises a pair of coils (31).

5. The movement (6) according to claim 4, wherein the coils (31) are diametrically opposite.

6. The movement (6) according to claim 1, wherein the electromagnetic regulator (29) comprises capacitors (36) coupled to the electronic circuit (33).

7. The movement (6) according to claim 1, further comprising a cover (37) mounted on the balance (11) and which closes the cavity (18) defined by the felloe (20).

8. The movement (6) according to claim 1, wherein the permanent magnet (30) is made of a neodymium-iron-boron alloy.

9. The movement (6) according to claim 8, further comprising at least two magnets (30) opposite each other, namely an upper magnet (30) fixedly mounted relative to the plate (7) on the side of the upper face (16) of the balance (11), and a lower magnet (30) fixedly mounted relative to the plate (7) on the side of the lower face (17) of the balance (11).

10. The movement (6) according to claim 1, wherein the electromagnetic regulator (29) comprises at least one pair of magnets (30) fixedly mounted relative to the plate (7) on the side of the upper face (16) of the balance (11).

11. The movement (6) according to claim 10, further comprising at least two pairs of magnets (30), namely a first pair of upper magnets (30) fixedly mounted relative to the plate (7) on the side of the upper face (16) of the balance (11), and a pair of lower magnets (30) fixedly mounted relative to the plate (7) on the side of the lower face (17) of the balance (11).

12. A watch (1) equipped with a movement (6) according to claim 1.

* * * * *